US009627189B2

(12) United States Patent
Deerberg et al.

(10) Patent No.: US 9,627,189 B2
(45) Date of Patent: Apr. 18, 2017

(54) VACUUM SYSTEM

(71) Applicant: Thermo Fisher Scientific (Bremen) GmbH, Bremen (DE)

(72) Inventors: Michael Deerberg, Bremen (DE); Michael Krummen, Bad Zwischenahn (DE); Ronald Seedorf, Weyhe (DE); Silke Seedorf, Weyhe (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/961,264

(22) Filed: Dec. 7, 2015

(65) Prior Publication Data

US 2016/0172179 A1 Jun. 16, 2016

(30) Foreign Application Priority Data

Dec. 12, 2014 (GB) ..... 1422124.6

(51) Int. Cl.

| | |
|---|---|
| ***H01J 49/24*** | (2006.01) |
| ***F04D 19/04*** | (2006.01) |
| ***F04B 37/14*** | (2006.01) |
| ***H01J 49/14*** | (2006.01) |

(52) U.S. Cl.

CPC ..... *H01J 49/24* (2013.01); *F04B 37/14* (2013.01); *H01J 49/147* (2013.01); *F04D 19/042* (2013.01)

(58) Field of Classification Search

CPC ..... F04D 19/046; F04D 19/042; F04D 25/00; H01J 49/24; H01J 37/3244; H01L 21/67126; H01L 21/67201; H01L 21/67742

USPC ..... 250/289; 417/423.4, 251; 219/121.43, 219/121.51

See application file for complete search history.

(56) References Cited

U.S. PATENT DOCUMENTS 5,733,104 A * 3/1998 Conrad ..... F04D 25/00 417/202
5,994,662 A * 11/1999 Murugesh ..... H01J 37/3244 156/345.33
7,850,434 B2 * 12/2010 Stones ..... F04D 19/04 417/250
7,866,940 B2 * 1/2011 Stones ..... F04D 17/168 415/143

(Continued)

FOREIGN PATENT DOCUMENTS

GB 2504329 A 1/2014

*Primary Examiner* — David A Vanore
(74) *Attorney, Agent, or Firm* — David A. Schell

(57) ABSTRACT

The invention concerns a vacuum system, comprising a first vacuum chamber and a second vacuum chamber, the first vacuum chamber being evacuated by a first vacuum pump, in particular a turbomolecular pump, the first and the second vacuum chamber being connected by a passage, wherein the passage is surrounded by a sealing arrangement comprising an inner seal and an outer seal with a plenum positioned between the inner seal and the outer seal, the plenum being evacuated by a support vacuum pump, and wherein at least one sealing face of the inner seal consists of the wall material of the first or the second vacuum chamber, in particular the inner seal being formed by direct contact between the wall material of the first vacuum chamber and the wall material of the second vacuum chamber. Additionally, the invention concerns a mass spectrometry system.

17 Claims, 7 Drawing Sheets

(56) References Cited

U.S. PATENT DOCUMENTS

| | | | | |
|---|---|---|---|---|
| 8,105,013 | B2 * | 1/2012 | Stones | F04D 19/046 415/116 |
| 8,529,218 | B2 * | 9/2013 | Makarov | F04D 19/042 250/289 |
| 8,740,587 | B2 * | 6/2014 | McCauley | F04D 19/042 137/565.23 |
| 8,858,188 | B2 * | 10/2014 | Makarov | F04D 19/042 415/90 |
| 2002/0159864 | A1 * | 10/2002 | Lowrance | H01L 21/67126 414/217 |
| 2007/0258836 | A1 * | 11/2007 | Hofmann | F04D 19/042 417/423.4 |
| 2010/0098558 | A1 | 4/2010 | Makarov | |
| 2015/0056060 | A1 * | 2/2015 | Makarov | F04D 19/046 415/1 |

* cited by examiner

VACUUM SYSTEM

FIELD OF THE INVENTION

The invention relates to a vacuum system comprising multiple vacuum chambers and multiple vacuum pumps. Further, the invention relates to a mass spectrometry system comprising a vacuum system with multiple vacuum chambers and multiple vacuum pumps.

BACKGROUND OF THE INVENTION

Scientific instruments such as mass spectrometers often require high or ultra high vacuum conditions in at least the lowest pressure stage, where e.g. detection takes place. Especially in isotope ratio mass spectrometry, deflection mass spectrometers with multiple collectors are advantageous due to their high precision and dynamic range; these multicollector mass spectrometers need large vacuum systems with a plurality of pressure stages. In general, vacuum chambers for these instruments are made from stainless steel, often using prefabricated standard parts such as flanges; different vacuum chambers are interconnected by flanges welded to the wall of respective chamber. The heat introduced during welding may lead to deformation of the work pieces, so that manufacturing precision is limited. Sealing of the connection between a first vacuum chamber and a second vacuum chamber is generally performed by metal seals such as gold or silver wire gasket—which are difficult to use—or copper gaskets (for CF flanges)—which are only available in a limited set of sizes. As a consequence, the cost for manufacturing of the vacuum systems is high, and dimensions are often limited by the available standard components.

UK patent GB 249233 B discloses a vacuum apparatus having a vacuum pump for evacuating two or more volumes, the pump having a number of pressure stages and at least two suction inlets, wherein an outer suction inlet for a first pressure stage is connected to a first volume for evacuation thereof, which first volume spatially surrounds an inner suction inlet for second pressure stage which is connected to a second volume for evacuation thereof, such that the inner suction inlet is an ultra high vacuum inlet and only seals against pressure within the first volume and not against an external pressure, and is separated from the first volume by a metal-to-metal seal that does not cause plastic deformation of the metals of the seal. It is particularly well suited for small ion trap mass spectrometers, where the ion trap is in an ultrahigh vacuum inner volume and other vacuum stages comprising further ion optical elements can be built around the ultra high vacuum volume to facilitate sealing. However, with commercially available multiport pumps such as split-flow turbomolecular pumps, this concept is limited to small instruments.

UK patent application GB 2504329 A describes a sealing arrangement for an ultra high vacuum pump having first and second housing members, the first housing member housing a pumping mechanism, the sealing arrangement being positioned to provide a seal between the first and second housing members, wherein the sealing arrangement comprises inner and outer seals extending around the periphery of the first housing member and a plenum positioned between the inner seal and the outer seal, and wherein pumping means are provided for pumping the plenum to a sub-atmospheric pressure. In a preferred embodiment, the pumping means is provided by parts of the pumping mechanism; this concept aims at manufacturing ultra high vacuum pumps with a cheaper envelope.

Against this background it is a goal of this invention to provide for a cheap and reliable vacuum system for applications requiring high or ultra high vacuum, in particular requiring ultra high vacuum volumes of more than 1000 $cm^3$.

SUMMARY OF THE INVENTION

According to an aspect of the present invention there is provided a vacuum system, comprising a first vacuum chamber and a second vacuum chamber, the first vacuum chamber being evacuated by a first vacuum pump, in particular a turbomolecular pump, the first vacuum chamber and the second vacuum chamber being adjacent and connected by a passage, wherein the passage is surrounded by a sealing arrangement comprising an inner seal and an outer seal with a plenum positioned between the inner seal and the outer seal, the plenum being evacuated by a support vacuum pump, and wherein at least one sealing face of the inner seal consists of the wall material of the first or the second vacuum chamber, in particular the inner seal being formed by direct contact between the wall material of the first vacuum chamber and the wall material of the second vacuum chamber.

In the context of the present application, the first vacuum chamber and the second vacuum chamber may, but do not need to, correspond to different pressure stages; in other words, the passage between the first vacuum chamber and the second vacuum chamber may have a high conductance, up to a conductance corresponding to the inner dimensions of the first or second vacuum chamber, so that both vacuum chambers form a common pressure stage. Preferably, the first vacuum chamber and the second vacuum chamber are held together by multiple screws.

The passage in the joining face of the first vacuum chamber and the second vacuum chamber may have an arbitrary shape; the sealing arrangement is generally positioned circumferentially to the passage in the joining face. In this context, the expression that the passage is surrounded by the sealing arrangement should be understood to mean that circumferentially to the gap of the joining face, at least one seal of the sealing arrangement is to be found. Inner seal and outer seal do not need to be strictly concentric, as long as the area between the two seals is completely and without hole or interruption formed by the wall material of the vacuum chambers. As a consequence, vacuum systems of arbitrary dimensions can be built, particularly in view of the fact that the inventive concept can easily be adapted for multichamber vacuum systems of pair wise interconnected vacuum chambers. A plurality of plenums, i.e. distribution ducts for vacuum, may be interconnected and evacuated by a single support vacuum pump.

The pressure stage formed by the first vacuum chamber and/or second vacuum chamber can be evacuated to ultra high vacuum; relative to the ultra high vacuum volume, the vacuum system according to the invention is fully metal sealed. This is particularly advantageous for gas isotope mass spectrometers, so that this pressure stage may e.g. house the electrostatic analyzer of a double-focusing deflection mass spectrometer preferably of the Nier Johnson type. Any outgassing from the outer seal, which may e.g. comprise an elastomer O-ring, is being pumped away by the support vacuum pump. As a consequence, a vacuum system according to the invention combines the advantages of a metal sealed vacuum chamber, e.g. no contamination by outgassing of the O-rings and the possibility to heat out the vacuum chamber, with the advantages of O-ring sealed vacuum chambers, where less screws may be used to tighten the connection between first vacuum chamber and second vacuum chamber, and where no replacement of the gasket after opening the sealed connection is necessary. Moreover, slightly damaged sealing surfaces (resulting in small leakages) do not affect the final pressure reached in the ultra high vacuum chamber, which reduces the risk for failure in a specification test of the vacuum system and thus simplifies the production process. Only the outer seal with the elastomer O-rings seals against atmosphere, whereas the inner seal made at least partially from the wall material of at least one of the vacuum chambers seals against the support vacuum, advantageously under molecular flow conditions. Especially in conjunction with a turbomolecular pump being used as support vacuum pump, the final pressure reached in the vacuum system may be improved by up to two or three orders of magnitude compared to a conventional vacuum system.

Preferably the first and/or the second vacuum chamber are made from metal, in particular aluminum, wherein the inner seal comprises a first sealing face consisting of the wall material of the first vacuum chamber and a second sealing face consisting of the wall material of the second vacuum chamber, wherein the outer seal comprises an elastomer O-ring, preferably a fluoropolymer elastomer O-Ring, in particular consisting of Viton or Kalrez, wherein the elastomer O-Ring is preferably held in place by a channel in the wall material of the first vacuum chamber or the second vacuum chamber, and wherein in particular one side bar of the channel is recessed relative to the first or the second sealing face.

The vacuum chambers may be made from block material machined in a CNC milling cutter. Preferentially, the first vacuum chamber is made from a first block of metal, in particular aluminum, and the second vacuum chamber is made from a second block of metal, in particular aluminum. Having the wall materials of the vacuum chambers made from aluminum reduces manufacturing cost, because aluminum is easy to machine. The form of the passage may be chosen arbitrarily, because manufacturing O-rings of a corresponding dimension is easy and cheap. Holding the O-Ring in place with a recessed bar allows for pumping any leaks or outgassing of the O-Ring via the support pump, so that dead volumes are avoided and a low vacuum pressure is reached faster. The first and the second sealing face of the inner sealing can preferably be made flat; the surface may be in particular machined and/or polished in order to be planar and free from scratches.

According to a preferred embodiment of the invention, the first and/or the second vacuum chamber comprises a port in the wall, the port being covered by a cap, wherein the port is surrounded by a sealing arrangement comprising an inner seal and an outer seal with a plenum positioned between the inner seal and the outer seal, wherein one sealing face of the inner seal consists of the wall material of the first and/or the second vacuum chamber and wherein the plenum associated to the port is connected to the plenum associated to the passage, so that both the passage plenum and the port plenum are evacuated by the support vacuum pump. In this embodiment, access to components inside the vacuum chamber may be provided while keeping the metal-sealed inner volume.

According to a particularly preferred embodiment of the invention, the port plenum is formed between the cap covering the port and a second cap covering an interior port to the first and/or second vacuum chamber, so that the port plenum comprises a substantial fraction of the area of the port, wherein one sealing face of the inner seal consists of the material of the second cap, in particular stainless steel or aluminum. This embodiment is particularly advantageous for ports covering substantial fractions of a side wall of a vacuum chamber, because good pumping is provided; moreover, other plenums may easily be connected.

It is preferred when the first vacuum chamber and/or the second vacuum chamber comprise a mechanical feedthrough, wherein the joining face of vacuum chamber and feedthrough is surrounded by a sealing arrangement comprising an inner seal and an outer seal with a plenum positioned between the inner seal and the outer seal, and wherein the plenum associated to the feedthrough is connected to the plenum associated to the passage, so that both the feedthrough plenum and the port plenum are evacuated by the support vacuum pump. The feedthrough plenum may preferably be connected indirectly to the passage plenum; when e.g. the second chamber comprises a feedthrough and a port, the feedthrough plenum may be connected to the port plenum, which is connected to the passage plenum. A mechanical feedthrough for manipulations inside the vacuum may be of a translational or a rotational type.

It is particularly preferred when the feedthrough comprises a movable shaft, a bearing and a housing which is being fixed, in particular bolted, to the wall of the vacuum chamber, wherein the outer seal comprises at least two elastomer O-rings, a first O-ring positioned between housing and movable shaft, and a second O-ring positioned between housing and wall of the vacuum chamber, wherein the inner seal comprises two sealing areas, a first sealing area between the housing and the wall of the vacuum chamber, and a second sealing area between the housing and the movable shaft and wherein the plenum comprises a first volume adjacent to the first sealing area and a second volume adjacent to the second sealing area, wherein the first and the second volume are interconnected by at least one hole drilled into the housing. The inventive mechanical feedthrough advantageously allows for avoiding pressure surges in the ultra high vacuum chamber caused by moving the shaft, because the support vacuum pump will quickly pump away any gas introduced by a motion-induced leak.

Preferentially the first and/or the second vacuum chamber comprise an electrical feedthrough, wherein the joining face of vacuum chamber and feedthrough is surrounded by a sealing arrangement comprising an inner seal and an outer seal with a plenum positioned between the inner seal and the outer seal, and wherein the plenum associated to the feedthrough is connected to the plenum associated to the passage, so that both the feedthrough plenum and the port plenum are evacuated by the support vacuum pump. Components for electrical feedthroughs are commercially available and capable of handling the high voltages (typically up to 10 kV) needed in an electron impact ion source and/or an electrostatic analyzer. Inside the vacuum chamber, wiring may be manufactured from bare rigid wires which are bent in a desired form so as to ensure a sufficient insulating distance between a high voltage wire and ground or a second wire.

Particularly preferentially the first and/or the second vacuum chamber comprises a heating arrangement which is wired to the electrical feedthrough, in particular a light bulb, and wherein the wiring is at least partially insulated by a heat-resistant material, in particular kapton. By heating out the vacuum chamber, contaminants on the wall of the vacuum chamber may be removed more quickly, so that a lower final pressure in the ultra high vacuum range may be reached more quickly.

Preferably an adapter piece is fixed, in particular bolted, to the first and/or the second vacuum chamber, the adapter piece comprising a standard vacuum flange, in particular a conflat flange, wherein the joining face of vacuum chamber and adapter is surrounded by a sealing arrangement comprising an inner seal and an outer seal with a plenum positioned between the inner and the outer seal, and wherein the plenum associated to the adapter piece is connected to the plenum associated to the passage, so that both the adapter plenum and the passage plenum are evacuated by the support vacuum pump. The adapter plenum may in particular be connected indirectly to the passage plenum; when e.g. the first chamber comprises a feedthrough and an adapter, the adapter plenum may be connected to the feedthrough plenum, which is connected directly or indirectly to the passage plenum. The adapter can advantageously be made from a different material than the vacuum chamber, in particular stainless steel. This allows e.g. for using copper gaskets when connecting additional vacuum equipment, so that the final pressure of the vacuum system does not deteriorate by the additional vacuum equipment.

For ports of small to medium size, adapter pieces made from stainless steel may be fixed to a vacuum chamber and sealed against atmosphere by an alternative sealing arrangement with only one seal. In the alternative sealing arrangement, a rim is made from the wall material of the vacuum chamber, wherein the dimensions of the rim preferably correspond to the dimensions of a standard CF copper gasket. In particular, inner and outer diameter of the annular rim may correspond to the dimensions of a standard CF copper gasket, and the height of the rim may be equal or higher than the thickness of the copper gasket. Preferably, the stainless steel adapter piece comprises cutting edges on both axial ends. When fixing the adapter piece to the vacuum chamber, the cutting edge deforms the rim to provide an ultra high vacuum compatible seal against atmosphere. This alternative sealing arrangement is particularly useful for adapter pieces which do not need to be removed during the lifetime of the vacuum system, providing a reliable and cost-effective seal.

According to a preferred embodiment of the invention, the first vacuum pump is a turbomolecular pump or an ion getter pump, wherein the second or a third vacuum chamber is evacuated by a second vacuum pump, in particular a turbomolecular pump or an ion getter pump, wherein the joining face of first vacuum chamber and first vacuum pump and/or the joining face of second or third vacuum chamber and second vacuum pump is/are surrounded by a sealing arrangement comprising an inner seal and an outer seal with a plenum positioned between the inner and the outer seal, and wherein the plenum associated to the first and/or second vacuum pump is connected to the plenum associated to the passage, so that both the pump plenum and the passage plenum are evacuated by the support vacuum pump.

According to a particularly preferred embodiment of the invention, the first vacuum pump and the second vacuum pump are formed by different stages of a multiport turbomolecular pump, wherein preferably the support vacuum pump is formed by a further stage of the multiport turbomolecular pump, in particular the last stage connected to a fore-vacuum pump. For relatively small volumes and/or limited gas loads, a multiport/split flow turbomolecular pump provides a cost-effective pumping means.

According to an alternative particularly preferred embodiment of the invention, the first vacuum pump and the second vacuum pump are separate turbomolecular pumps, and wherein the support vacuum pump is formed by a dedicated turbomolecular pump. Using separate vacuum pumps is particularly useful for vacuum systems with an ultrahigh vacuum volume exceeding 1000 $cm^3$.

Preferentially the first and/or the second vacuum chamber are made from metal, in particular aluminum, wherein the inner seal comprises a first sealing face consisting of the wall material of the first vacuum chamber and/or the wall material of the second vacuum chamber, wherein the outer seal comprises an elastomer O-ring, preferably a fluoropolymer elastomer O-Ring, and wherein a second sealing face consists of the wall material of an external component fixed, in particular bolted, to the first and/or the second vacuum chamber. The component fixed to the vacuum chamber may be a cap, a housing of a feedthrough, an adapter piece or a housing of a pump or a pressure sensor. In the inventive vacuum concept, aluminum vacuum chambers may be connected with standard components made from stainless steel while maintaining a metal-sealed inner volume.

Preferably at least one plenum and/or the connection between a first plenum and a second plenum is/are made by holes drilled and/or channels milled in the wall material of the first and/or the second vacuum chamber. Advantageously, all of the plenums associated to any additional element fixed (in particular bolted) to one of the vacuum chambers are interconnected, so that a single support vacuum pump provides a support vacuum for the whole vacuum system. When manufacturing the vacuum chambers, suitable plenums can easily be machined by the CNC milling cutter machining the walls of the vacuum chambers.

In a preferred embodiment of the present invention, the vacuum system further comprises multiple chambers interconnected by passages and/or apertures, wherein at least one further vacuum chamber is connected to the first and/or second vacuum chamber, the further vacuum chamber being evacuated by a further vacuum pump, in particular a turbomolecular pump or ion getter pump, the vacuum chamber and the first and/or second vacuum chamber being connected by a passage, wherein the passage is surrounded by a sealing arrangement comprising an inner seal and an outer seal with a plenum positioned between the inner seal and the outer seal, the plenum being evacuated by a support vacuum pump, and wherein at least one sealing face of the inner seal consists of the wall material of the first or the second vacuum chamber, in particular the inner seal being formed by direct contact between the wall material of the first vacuum chamber and the wall material of the second vacuum chamber. Advantageously, the inventive concept allows for constructing vacuum systems comprising an arbitrary number of adjacent vacuum chambers and/or pressure stages.

In a particularly preferred embodiment of the invention, the first vacuum chamber comprises a cylindrical port of a first inner diameter machined in the wall material of the first vacuum chamber with a stop rim having a smaller inner diameter than the first diameter being located at the axially inner end of the cylindrical port, wherein a cylindrical workpiece with a first outer diameter matching the first inner diameter is pressed against the stop rim, so that a first seal is formed between the wall of the cylindrical workpiece and the stop rim, wherein the axially outside face of the cylindrical workpiece comprises a wall section of second outer diameter, the second outer diameter being smaller than the first inner diameter, wherein the cylindrical workpiece further comprises a membrane joining the wall parts of the first and the second outer diameter, the cylindrical port further comprising an axially outside section with a second inner diameter, the second inner diameter being bigger than the first inner diameter, wherein a second seal is formed between the wall section of second outer diameter and the wall material of the further vacuum chamber, wherein the axially outside section is connected to one of the plenums evacuated by the support vacuum pump, and wherein a third seal is formed between the wall material of the further vacuum chamber and the axially outside wall material of the first vacuum chamber, so that the third seal seals against atmosphere and the first seal and second seal provide sealing against the support vacuum. Preferably, the cylindrical workpiece is made from stainless steel; in particular, the third seal may comprise an elastomer O-ring. In particular a lathe workpiece from stainless steel provides sufficient elasticity and stability. This embodiment allows for a reproducible interconnection to the further vacuum chamber, so that the vacuum system may be taken apart for easier transport and the rejoined with limited or no readjustments.

According to another aspect of the present invention, there is provided a mass spectrometry system comprising a vacuum system according to any one preceding claim, wherein the first vacuum chamber and/or the second vacuum chamber houses an ion source, in particular an electron impact ion source, wherein the second vacuum chamber or a third vacuum chamber houses an ion-optical element, in particular an electrostatic analyzer, and wherein at least one further vacuum chamber is connected to or forms part of the vacuum system, wherein preferably the further vacuum chamber houses an ion detector. The mass spectrometry system may in particular comprise a double focusing deflection mass analyzer, with an electrostatic analyzer for selecting the ion energy, a magnetic sector field for impulse selection and a multicollector detection array suitable for the simultaneous detection of multiple masses in order to determine accurate intensity ratios. Preferably, the ion source is of the electron impact ionization type suitable for a gas isotope ratio mass spectrometer.

DETAILED DESCRIPTION OF EMBODIMENTS

In order to further understand the invention, embodiments will now be described in detail by way of example with reference to the accompanying drawings, which are for illustration only and are not intended to and do not limit the scope of the invention.

LIST OF FIGURES

Figure 1:
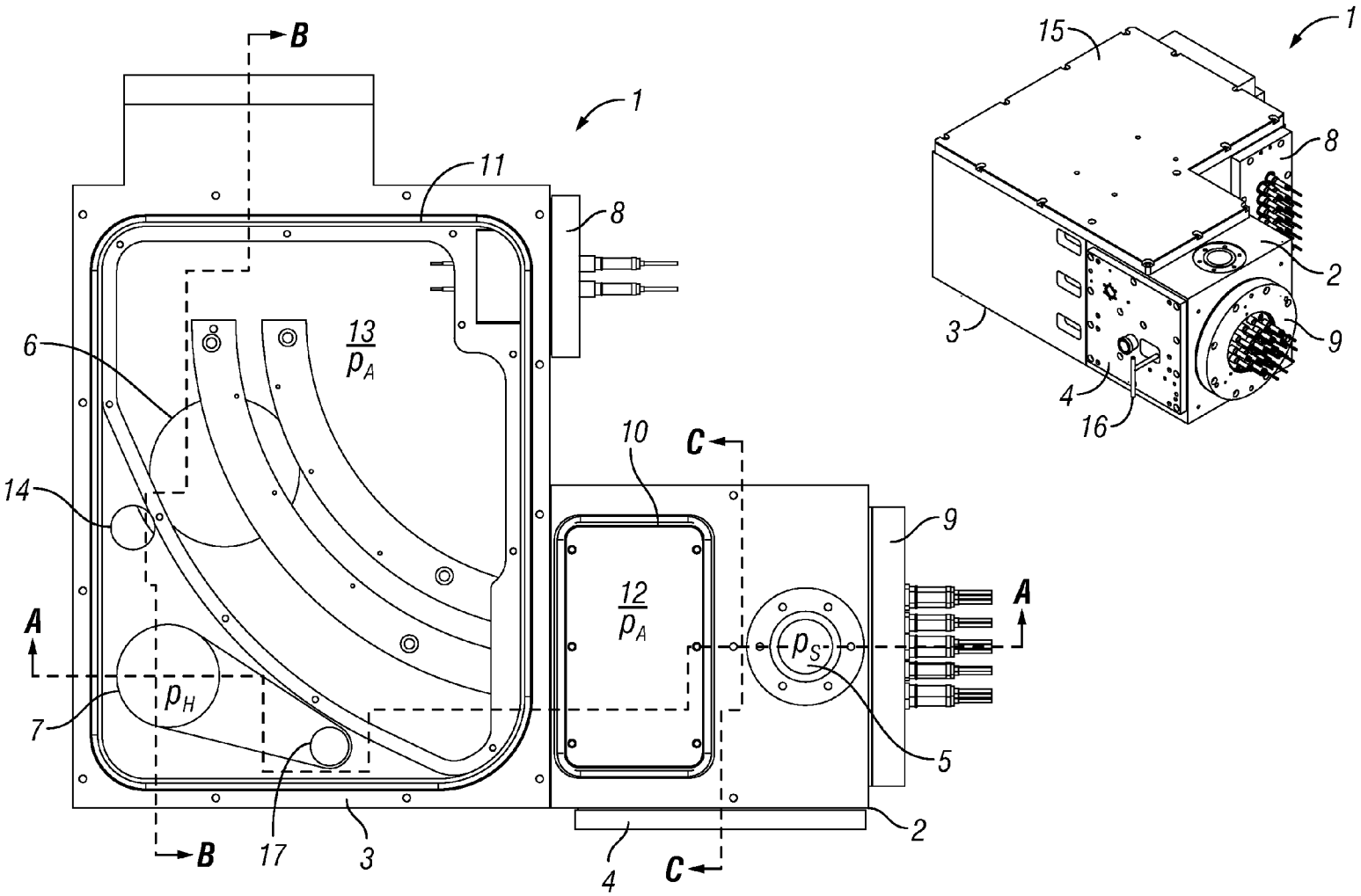
FIG. 1 shows two schematic views of a vacuum system according to a preferred embodiment of the invention.

Referring to FIG. 1, two views of a vacuum system 1 according to a preferred embodiment of the invention are shown. A top view of the vacuum system is depicted in the center of the figure. In this view, three different cuts along the lines A-A, B-B and C-C are indicated which will be shown in the following figures. Additionally, a perspectives' view of the vacuum system is shown. The vacuum system 1 is constructed from a first block of metal 2 and a second block of metal 3 which are machined to form the vacuum chambers and ports for connecting further vacuum equipment; preferably the metal may be aluminum. In principle, other materials suitable for vacuum applications, such as stainless steel, could be used for the construction of the walls of the vacuum chambers. The vacuum system comprises three pressure stages, two main pressure stages $p_S$, $p_A$ and a support pressure stage $p_H$. According to a particularly preferred embodiment, the first pressure stage $p_S$ houses an ion source and the second pressure stage $p_A$ houses an electrostatic analyzer.

The first pressure stage $p_S$ comprises a single vacuum chamber, the source chamber 20, which is separate from the second pressure stage $p_A$ by a wall containing a small aperture, so that a pressure difference may be maintained between the two pressure stages. The source chamber 20 is evacuated by a vacuum pump, in particular a turbomolecular pump (not shown) which is connected to pump port 5; preferably the turbomolecular pump has a pumping speed of roughly 250 l/s. Sample gas may be introduced into the source chamber via gas inlet 16. Cap 4 covers a plenum which will be described below in connection with FIG. 4. Via electrical feedthrough 9, an ion source (not shown) may be provided with the voltages needed for producing an ion beam; the first pressure stage further comprises a port 18 leading to a first pressure sensor (not shown), in particular a penning ionization gauge. Without the introduction of sample gas, the first pressure stage $p_S$ preferably is at a pressure below $5*10^{-10}$ mbar, in particular around $1*10^{-10}$ mbar.

The second pressure stage $p_A$ comprises a first vacuum chamber 13 and a second vacuum chamber 12, which are preferably bolted together; components housed by the two vacuum chambers may be accessed via two ports 10, 11 which are covered by an outer cap 15. Details of the vacuum-tight connection of the two vacuum chambers 12, 13 and of the sealing concept for the ports will be discussed below. Voltages for operating an electrostatic analyzer or other ion-optical components can be supplied via electrical feedthrough 8. The two vacuum chambers are evacuated by a further vacuum pump (not shown) which is connected to pump port 6; preferably the further vacuum pump is a turbomolecular pump which in particular has a pumping speed of roughly 250 l/s. Preferably, the second pressure stage $p_A$ is at a pressure below $5*10^{-9}$ mbar, in particular around $1*10^{-9}$ mbar.

The support pressure stage $p_H$ comprises a plurality of plenums, in particular plenums 7, 14 and 17 which are interconnected by a volume below outer cap 15, as well as a number of other plenums, which are preferentially formed and/or interconnected by holes drilled or channels milled into the wall material of one or more of the vacuum chambers. According to a particularly preferred embodiment of the invention, a third vacuum pump, preferably a turbomolecular pump (not shown) is connected to plenum 7; a third pressure sensor (not shown), in particular a penning ionization gauge, is connected to plenum 17. Plenum 14 leads to a channel milled circumferential around the joining face of vacuum chamber and first vacuum pump, i.e. a section through pump port 6. The joining face is surrounded by a sealing arrangement comprising an inner seal, an outer seal and the channel/plenum positioned between the inner and the outer seal which can be evacuated via plenum 14. Preferably, the support pressure stage $p_H$ is at a pressure below $5*10^{-7}$ mbar, in particular around $1*10^{-7}$ mbar. Generally, a dry fore-vacuum pump could be used for supplying the support vacuum; in that case, a pressure around $1*10^{-3}$ mbar would prevail in the support pressure stage. Using a turbomolecular pump for evacuating the plenums allows for reaching lower final pressures.

Figure 2:
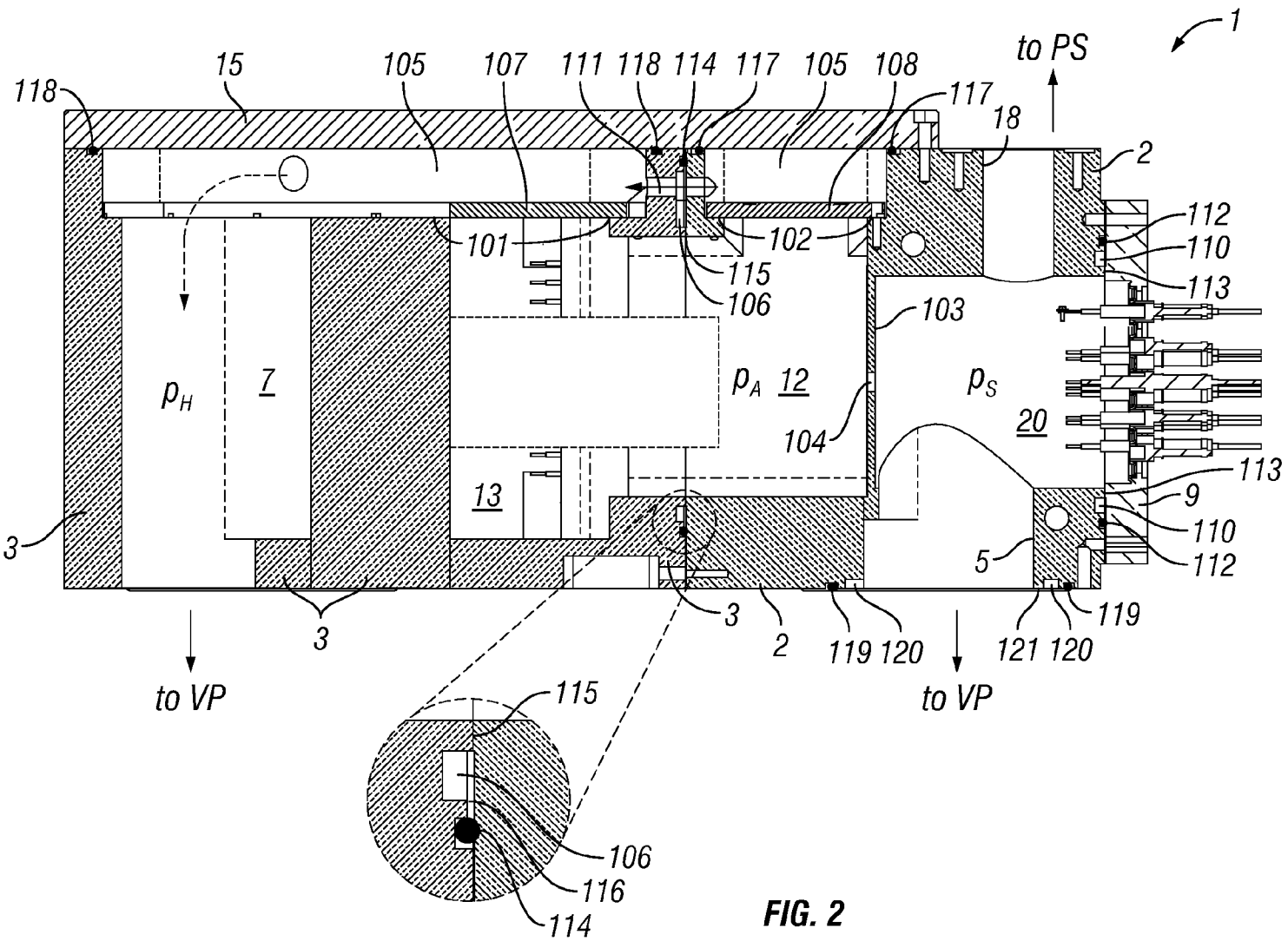
FIG. 2 shows a cut along the line A-A through the vacuum system of the preferred embodiment.

FIG. 2 shows a cut along the line A-A through the vacuum system 1 of the preferred embodiment. In this figure and in the following figures, corresponding elements are labelled by the same reference numeral.

The first pressure stage $p_S$ comprising the source chamber 20 with port 5 to the vacuum pump and port 18 to the first pressure sensor is separated from the second pressure stage $p_A$ by a wall 103 with a small aperture 104; the aperture 104 may contain a slit for defining an ion beam. The first vacuum pump may be fixed directly or via an adapter piece to the wall 2 of the source chamber. The joining face of source chamber 20 and vacuum pump (or adapter piece) is surrounded by a sealing arrangement comprising an inner seal 121 and an outer seal 119 with a plenum 120 positioned between the inner seal 121 and the outer seal 119, such that the sealing arrangement is circumferential to pump port 5. Plenum 120 is connected indirectly to plenum 7 and as a consequence to the support vacuum pump, so that any gas leaked through or evaporated from the outer seal 119 is pumped away. The first sealing face of the inner seal 121 consists of the wall material 2 of the source chamber 20, and the second sealing face of the inner seal 121 is formed from the flange of the first vacuum pump or an adapter piece. As a consequence, the connection between vacuum pump and source chamber 20 is metal sealed. Voltages for components in the source chamber 20 are supplied by electrical feedthrough 9; the vacuum tight flange of the feedthrough 9 faces a feedthrough port in the wall material 2 of the source chamber 20. The joining face is surrounded by a sealing arrangement comprising an inner seal 113 and an outer seal 112 with a plenum 110 positioned between the inner seal 113 and the outer seal 112; the plenum 110 is connected indirectly to the support vacuum pump.

The second pressure stage $p_A$ comprises a first vacuum chamber 13 and a second vacuum chamber 12; the walls of the second chamber 12 are preferably machined from the same block of metal 2 as the walls of the source chamber 20, whereas the walls of the first chamber are machined from a second block of metal 3. The passage between first vacuum chamber 13 and second vacuum chamber 12 comprises a substantial fraction of the joining face of the blocks of metal 2, 3. Circumferential to the passage, a sealing arrangement is provided which comprises an inner seal 115 and an outer seal 114 with a plenum 106 positioned between the inner seal 115 and the outer seal 114. A first sealing face of the inner seal 115 consists of the wall material 3 of the first vacuum chamber 13, and a second sealing face of the inner seal 115 consists of the wall material 2 of the second vacuum chamber 12. Preferably, the sealing faces are machined to tight tolerances in a CNC milling machine; optionally an additional surface treatment such as polishing or honing may be carried out. Advantageously, leak rates of the inner 115 seal up to the leak rate of an aperture connecting adjacent vacuum chambers are permissible without significant increase in the final pressure reached. Circumferential to the inner seal 115, a plenum 106 associated to the passage is provided; this plenum may at least partially be formed by channels machined into the wall material of one or both of the vacuum chambers. The plenum 106 is connected by a hole 111 drilled or machined into the wall material of one or both of the vacuum chambers, to a further plenum volume 105 described below. The outer seal 114 comprises an O-Ring, in particular made from Viton or Kalrez, which is held in place by a channel machined in the wall material 3 of the first vacuum chamber; in principle, the channel could completely or partially be machined into the wall material 2 of the second vacuum chamber 12. When both the channel for plenum 106 and the channel for the O-Ring of the outer seal 114 are machined into one block of metal, in particular the one forming the wall material 3 of the first vacuum chamber 13, machining the other block of metal 2 is simplified. In order to minimize dead volumes, which would degas over an extended period of time and thus limit the speed at which the final pressure of the vacuum chamber is reached, the side wall of the O-Ring channel facing the plenum is recessed relative to the sealing face of the inner seal; this can be seen from the inlay shown in the circle.

The support pressure stage $p_H$ comprises a plurality of plenums; to each sealing arrangement, a generally annular plenum is associated. In principle, the shape of the O-Ring of the outer seal and the shape of the plenum associated to the respective sealing arrangement may have an arbitrary closed form. The sealing arrangement for the ports 10 and 11 shown in FIG. 1 also comprises an inner seal 101 and 102, an outer seal 118 and 117, and a plenum 105 positioned between the inner seal and the outer seal. In contrast to the sealing arrangements described above, the sealing arrangement of these two ports 10 and 11 comprises a plenum chamber 105 which covers a substantial portion of the area of the outer cap 15. The outer seal of port 11 as well as the outer seal of port 10 surrounds the area of the respective port, as was the case for the sealing arrangements described above. However, the inner seal 118 associated to port 11 is formed from the joining face between an inner cap 107 and the wall material 3 of the first vacuum chamber 13. Correspondingly, the inner seal 117 associated to port 10 is formed from the joining face between an inner cap 108 and the wall material 2 of the second vacuum chamber. The plenum chamber 105 between the inner seals, inner caps and the outer seals, outer cap has a high conductance and due to the large area and volume allows for easily connecting other plenums to the plenum chamber 105. Via plenum 7, the plenum chamber 105 and all connected plenums are evacuated by the support vacuum pump (not shown).

Figure 3:
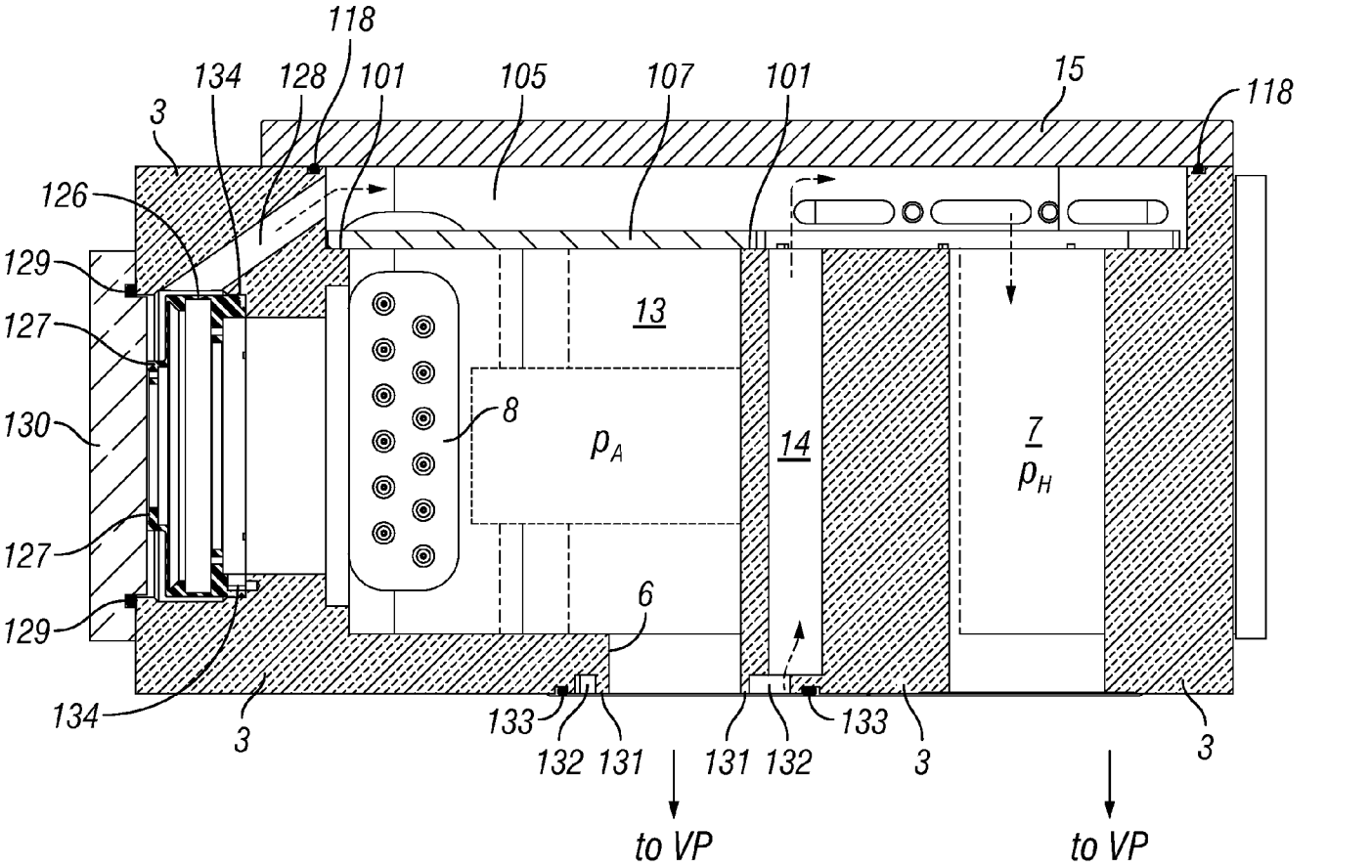
FIG. 3 shows a cut along the line B-B through the vacuum system of the preferred embodiment.

FIG. 3 shows a cut along the line B-B through the vacuum system 1 of the preferred embodiment. In this view, the first vacuum chamber 13 of the second pressure stage $p_A$, an inner face of electrical feedthrough 8 and the plenums 7, 14, 105, 128 of the support pressure stage $p_H$ can be seen.

The first vacuum chamber is evacuated via pump port 6; the port is surrounded by a sealing arrangement comprising an inner seal 131, an outer seal 133 and a plenum 132 positioned between the inner seal 131 and the outer 133. A first sealing face of the inner seal is formed from the wall material 3 of the first vacuum chamber 13, and a second sealing face is formed from the flange of the further vacuum pump (not shown) or an adapter piece (not shown) fixed to the first vacuum chamber 13. The pump plenum 132 is connected to plenum 14, which is connected to plenum chamber 105, which is connected to plenum 7; as a consequence, pump plenum 132 can be evacuated via the support vacuum pump attached to plenum 7. When the vacuum system 1 forms part of a scientific instrument, the first vacuum chamber may be connected to further vacuum chambers; in the current figure, an adjacent vacuum chamber is for simplicity represented by an end cap 130. In order to allow for a reproducible fit and a vacuum-tight connection to the adjacent vacuum chamber, a special adapter piece 126, preferably a pre-stressed component manufactured on a lathe, in particular consisting of stainless steel, is inserted into the wall material 3 of the vacuum chamber. The adapter piece comprises two metallic sealing faces 134 and 127, the diameter of sealing face 134 facing the first vacuum chamber 13 being considerably different from the diameter of sealing face 127; a thin wall or membrane joins the two sealing faces and allows for a defined but limited deformation. The sealing faces are part of an inner seal of a further sealing arrangement comprising the inner seal 127, 134, an outer seal 129 and a plenum 128 positioned between the inner seal 127, 134 and the outer seal 129, the plenum 128 being connected to the plenum chamber 105, which is situated between inner cap 107 and outer cap 15.

Figure 4:
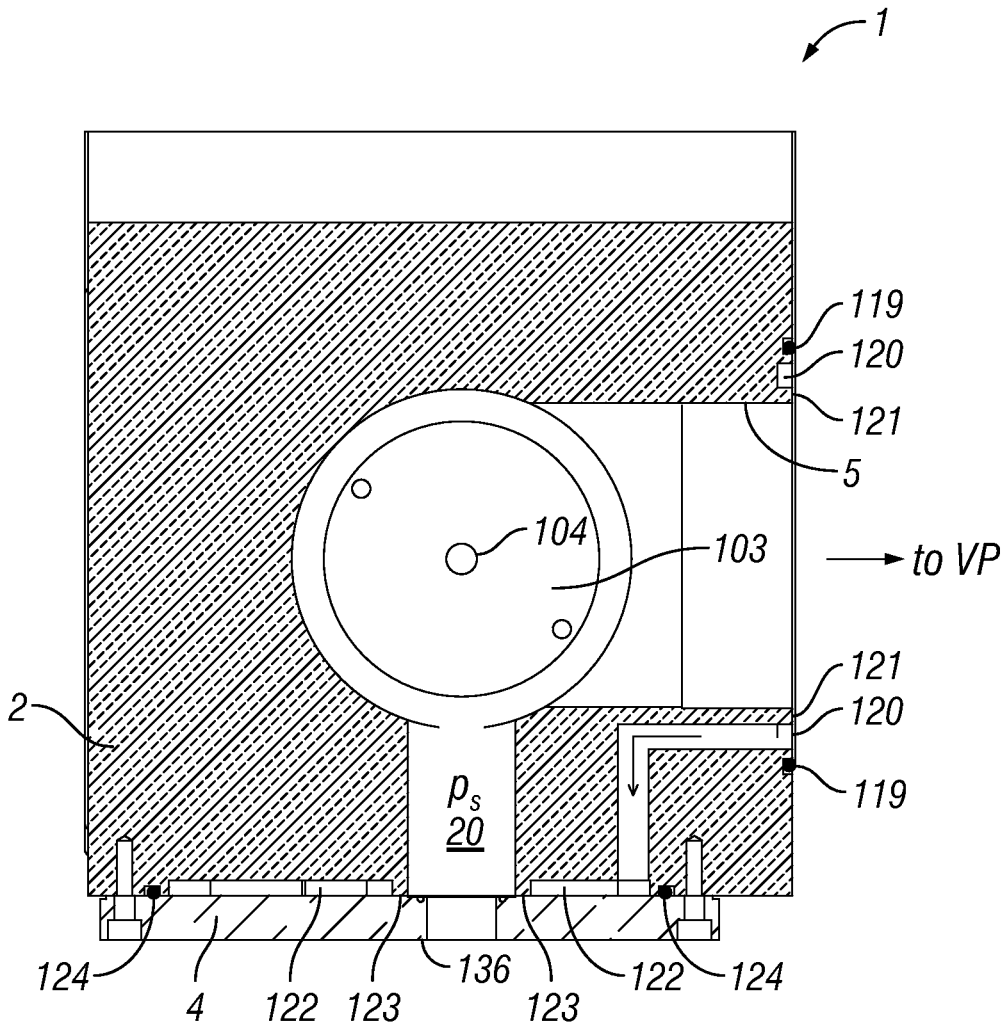
FIG. 4 shows a cut along the line C-C through the vacuum system of the preferred embodiment.

FIG. 4 shows a cut along the line C-C through the vacuum system 1 of the preferred embodiment.

In this figure, the source chamber 20 of the first pressure stage $p_S$ can be seen; via aperture 104 in wall 103, source chamber 20 is connected to the second vacuum chamber 12 of the second pressure stage $p_A$. Pump port 5 is connected directly or via an adapter piece to the vacuum pump (not shown); at the corresponding joining face, a sealing arrangement comprising an inner seal 121 and an outer seal 119 can be seen. A generally circular plenum 120 is positioned between inner seal 121 and outer seal 119. Via holes drilled in the wall material 2 of the source vacuum chamber 20, plenum 120 is connected indirectly to the support vacuum pump (not shown); this connection provided by plenum 122 located behind cap 4. Cap 4 is preferable made of stainless steel and comprises a circular port 136 to the source chamber, which houses an element that can be adjusted in order to vary the conductance of the ion source. Additionally, a gas inlet 16 for admitting the sample in the ion source is fixed to cap 4; preferably, the joining faces of cap 4 and adjustable element (not shown) as well as of cap 4 and gas inlet 16 are metal-sealed.

Figure 5:
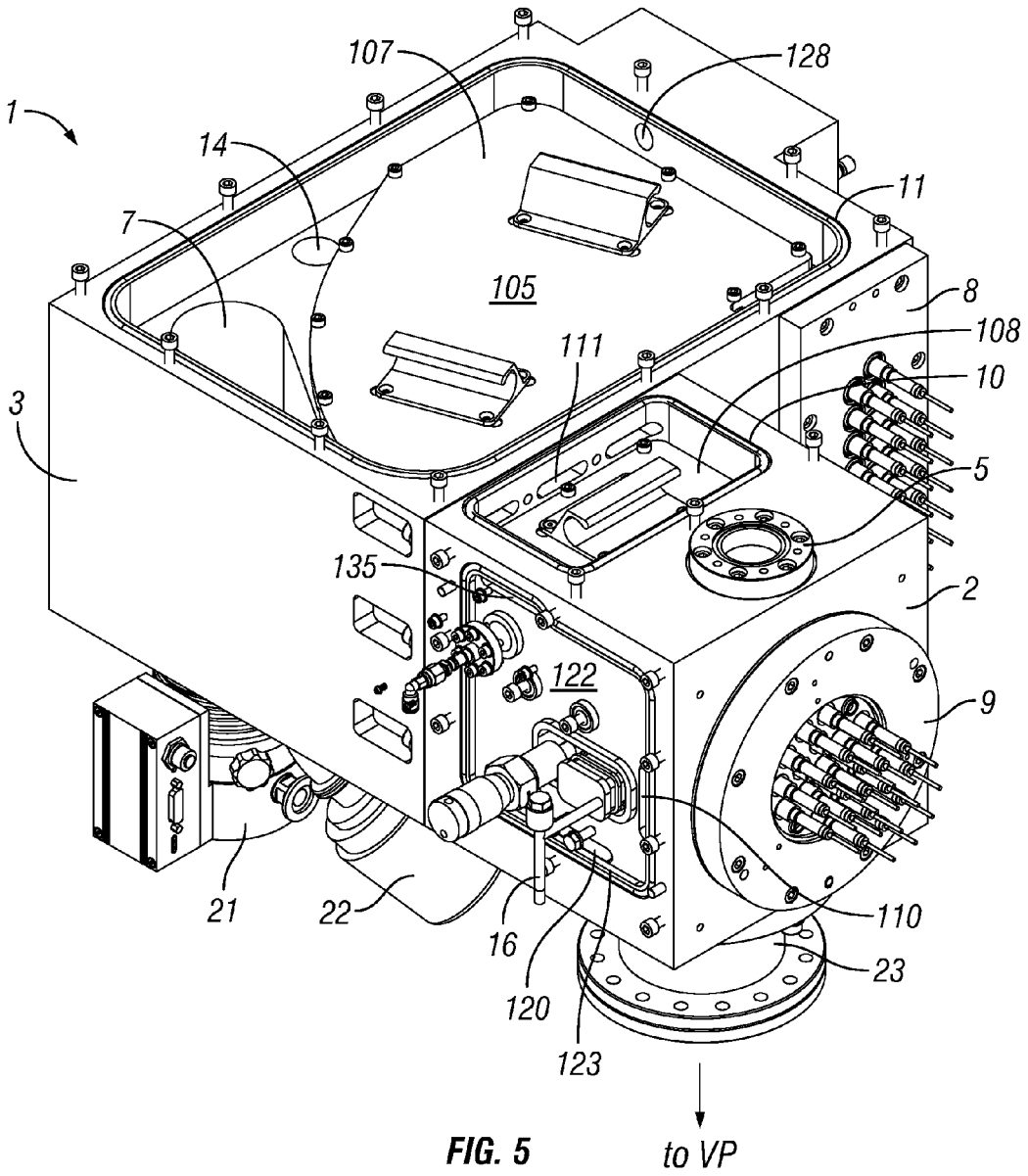
FIG. 5 shows an outside view of the vacuum system according to the preferred embodiment.

FIG. 5 shows an outside view of the vacuum system 1 according to the preferred embodiment, wherein caps 15 and 4 have been omitted in order to show more clearly plenums 105 and 122, who extend along a substantial fraction of the area of the caps as well as of the associated ports, so that the outer sealing of a port may be pumped by the support vacuum pump via a plenum covering the whole area of the port.

In this view, several interconnections between the different plenums can be seen: Plenum 105 is evacuated by support vacuum pump 21 via plenum 7; plenum 105 consists of two parts connected via holes 111 drilled or machined in the wall materials of first and second vacuum chamber. The sealing arrangement associated to the further vacuum pump (for evacuating the second pressure stage $p_A$) comprises plenum 14, which is evacuated indirectly via plenum 105. Further, the connection between plenum 128 and plenum 105 can be seen. Both plenum 120 of the sealing arrangement for the first turbomolecular pump (associated to source chamber 20), and plenum 110 of the sealing arrangement for the electrical feedthrough 9 are connected to plenum 122 located behind cap 4. The plenum 122 is connected to plenum 105 via hole 135 milled in the wall material 2 of the second vacuum chamber 12. As a consequence, plenums 110, 120 and 122 are evacuated by the support vacuum pump 21. In FIG. 5, an example of an adapter piece 23 for attaching the first turbomolecular pump to the source chamber 20 is shown.

Figure 6:
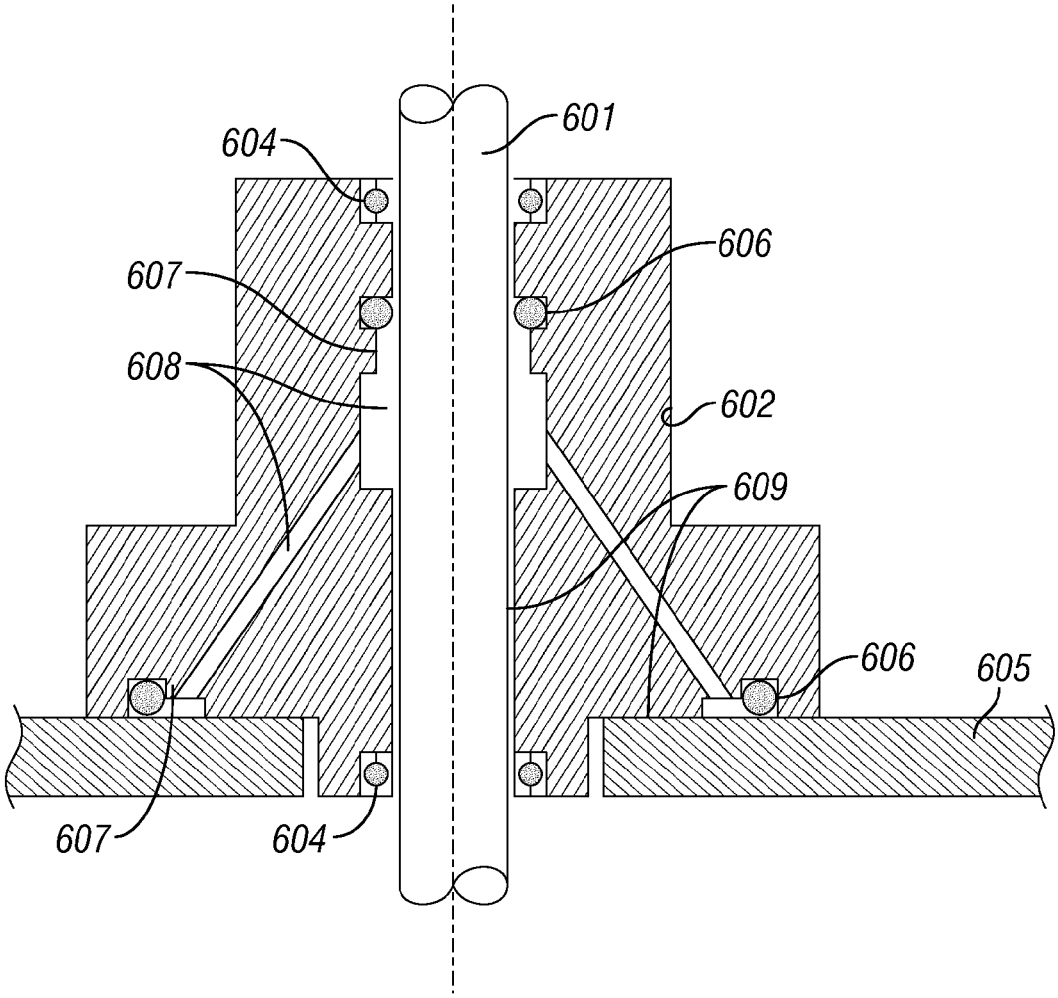
FIG. 6 shows a cut through a mechanical feedthrough in a vacuum system according to a further preferred embodiment of the invention.

FIG. 6 shows a cut through a mechanical feedthrough in a vacuum system according to a further preferred embodiment of the invention.

The mechanical feedthrough comprises a movable shaft 601, a housing 602, a bearing arrangement, and a sealing arrangement. In order to define the lateral motion between movable shaft 601 and housing 602 precisely, the bearing arrangement preferably comprises two bearings 604, in particular located at axially opposite ends of the housing 602. The bearings 604 in the bearing arrangement may be ball bearings (particularly suited for a rotational feedthrough) preferably made from ceramic or stainless steel or slide bearings (particularly suited for a translational feedthrough) preferably made from a vacuum compatible polymer such as polyether ether ketone (PEEK). Mechanical feedthrough 600 may be constructed partially as known in the art so that e.g. the joining surface between movable shaft 601 and fixed housing 602 may be sealed against atmospheric pressure by one or several elastomer O-rings (not shown). The housing 602 of the mechanical feedthrough is fixed, e.g. bolted, to a flange or wall 605 of a vacuum chamber; via a hole in the wall or flange 605, movable shaft 601 may be used for mechanical manipulations inside of a high or ultrahigh vacuum of the vacuum chamber. According to a preferred embodiment of the invention, the sealing arrangement comprises an outer seal 606, an inner seal 609 and a plenum 608 positioned between inner seal 609 and outer seal 606. The outer seal 606 comprises two elastomer O-rings, preferably made from a fluoropolymer elastomer such as Viton, a first O-ring sealing the joining face of housing 602 and movable shaft 601 and a second O-ring sealing the circumference of the joining face between feedthrough housing 602 and vacuum chamber wall 605. Preferably, each elastomer O-Ring is positioned in a channel machined in the housing 602 of the mechanical feedthrough, and is held in place by a side wall 607 which is recessed relative to the joining face of housing 602 and movable shaft 601 or vacuum chamber wall 605, respectively. The plenum 608 comprises a plenum chamber surrounding the movable shaft 601 and a plenum channel at the joining face of housing 602 and vacuum chamber wall; in the cut shown, plenum chamber and plenum channel are connected by two holes drilled in the housing 602. The inner seal 609 comprises a slide seal between housing 602 and movable shaft 601 as well as a flat seal between housing 602 and vacuum chamber wall 605. Because the lateral position of the movable shaft 601 is well defined by the bearing 604, the slide seal may be manufactured to tight tolerances, so that leakage between plenum 608 and high vacuum chamber is effectively limited.

A mechanical feedthrough as described above protects the high vacuum chamber against pressure surges caused by moving the movable shaft 601, because any gas that would pass seals 603 and 604 will be pumped away by the support vacuum pump.

Figure 7:
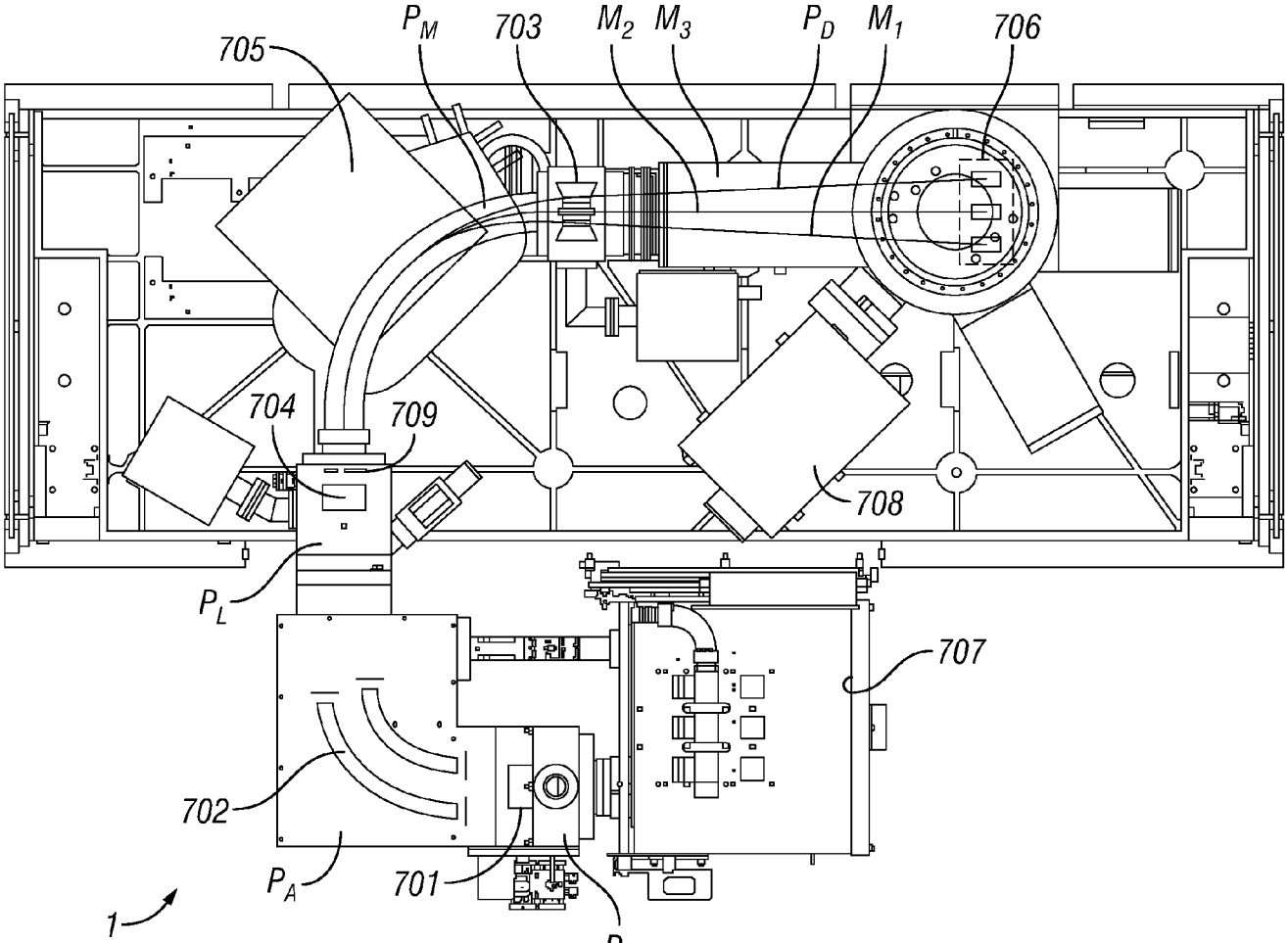
FIG. 7 shows a schematic top view of a mass spectrometer according to an embodiment of the invention.

FIG. 7 shows a schematic top view of a mass spectrometer, which is housed in a vacuum system comprising the vacuum system 1 described above.

The mass spectrometer contains an ion source 701, in particular an electron-impact ion source with multiple inlets for sample and reference gases, an electrostatic analyzer 702, an electrostatic acceleration lens 704, an adjustable aperture 709, a bending magnet 705 for separating ions according to their momentum, an adjustable electrostatic lens 703, and a detector array 706. An electronic compartment 707 supplies the voltages for the ion source 701 and the electrostatic analyzer 702; the electronic circuits for amplifying the detector signals are preferably housed in a detector compartment 708. The trajectories of exemplary ions $m_1$, $m_2$, $m_3$ are indicated by full lines; ions of different mass-to-charge ratios may be detected by different detectors in the detector array 706. For ions of the same charge, the innermost ions have the smallest mass, so that in the shown example the masses are $m_1<m_2<m_3$.

The vacuum system comprises multiple vacuum chambers arranged in a number of pressure stages, which are separated by apertures of limited conductance; additionally, valves may be used to separate the different pressure stages in case of the chambers has to be opened for service. It is a feature of the present invention that different materials for the vacuum chambers and the sealing arrangement may be combined, so that e.g. the pressure stage pp housing the ion source 701 and the pressure stage $p_A$ housing the electrostatic analyzer 702 may be constructed from aluminium using a sealing arrangement with an evacuated plenum, whereas the pressure stage $p_M$ housing the flight tube in the magnetic field may be constructed from stainless steel. In the case of the flight tube, the dimensions of the vacuum chamber are limited by the pole pieces of the magnet, so that constructing the walls from stainless steel is advantageous. The wall material and sealing concept of the pressure stage $p_L$, housing the electrostatic lens 704 and the adjustable aperture 709, and the pressure stage $p_D$, housing the detector array 706, material and sealing concept may in principle be chosen arbitrarily.

Generally, a vacuum system according to the invention may comprise a plurality of vacuum chambers of arbitrary dimensions interconnected by passages surrounded by sealing arrangements as described above. Unlike conventional metal seals, elastomer O-rings do not need to be replaced each time the corresponding connection is loosened. All plenums associated to a sealing arrangement of the multi-chamber vacuum system may be evacuated by a single support vacuum pump. As a consequence, the invention allows for reducing the cost of constructing vacuum systems with metal seals formed at least partially from the wall material of the high vacuum chamber. Vacuum chambers may be constructed from aluminum while keeping the advantages of a fully metal sealed vacuum system.

As used herein, including in the claims, unless the context indicates otherwise, singular forms of the terms herein are to be construed as including the plural form and vice versa.

Throughout the description and claims of this specification, the words "comprise", "including", "having" and "contain" and variations of the words, for example "comprising" and "comprises" etc., mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

The invention claimed is:

1. Vacuum system, comprising a first vacuum chamber (13) and a second vacuum chamber (12), the first vacuum chamber (13) being evacuated by a first vacuum pump, in particular a turbomolecular pump, the first vacuum chamber (13) and the second vacuum chamber (12) being adjacent and connected by a passage, wherein the passage is circumferentially surrounded by a sealing arrangement comprising an inner seal (115) and an outer seal (114) with a plenum (106) positioned between the inner seal (115) and the outer seal (114), the plenum (106) being evacuated by a support vacuum pump (21), and wherein at least one sealing face of the inner seal (115) consists of the wall material (2, 3) of the first vacuum chamber (13) or the second vacuum chamber (12), in particular the inner seal (115) being formed by direct contact between the wall material (3) of the first vacuum chamber (13) and the wall material (2) of the second vacuum chamber (12).

2. The vacuum system of claim 1, wherein the first vacuum chamber (13) and/or the second vacuum chamber (12) are made from metal, in particular aluminum, wherein the inner seal (115) comprises a first sealing face consisting of the wall material (3) of the first vacuum chamber (13) and a second sealing face consisting of the wall material (2) of the second vacuum chamber (12), wherein the outer seal (114) comprises an elastomer O-ring, preferably a fluoropolymer elastomer O-Ring, in particular consisting of Viton or Kalrez, wherein the elastomer O-Ring is preferably held in place by a channel in the wall material (3) of the first vacuum chamber (13) or wall material (2) of the second vacuum chamber (12), and wherein in particular one side bar (116) of the channel is recessed relative to the first or the second sealing face.

3. The vacuum system of claim 1, wherein the first vacuum chamber (13) and/or the second vacuum chamber (12) comprises a port (11, 10) in the wall of the vacuum chamber, the port (11, 10) being covered by a cap (15), wherein the port (11, 10) is surrounded by a sealing arrangement comprising an inner seal (101, 102) and an outer seal (118, 117) with a plenum (105) positioned between the inner seal (101, 102) and the outer seal (118, 117), wherein one sealing face of the inner seal (101, 102) consists of the wall material (3) of the first vacuum chamber (13) and/or the wall material (2) of the second vacuum chamber (12) and wherein the plenum (105) associated to the port (11, 10) is connected to the plenum (106) associated to the passage, so that both the passage plenum (106) and the port plenum (105) are evacuated by the support vacuum pump (21).

4. The vacuum system of claim 3, wherein the port plenum (105) is formed between the cap (15) covering the port (11, 10) and a second cap (107, 108) covering an interior port to the first vacuum chamber (13) and/or the second vacuum chamber (12), so that the port plenum (105) comprises a substantial fraction of the area of the port (11, 10), wherein one sealing face of the inner seal (101, 102) consists of the material of the second cap (107, 108), in particular stainless steel or aluminum.

5. The vacuum system of claim 1, wherein the first vacuum chamber (13) and/or the second vacuum chamber (12) comprise a mechanical feedthrough, wherein the joining face of vacuum chamber and feedthrough is surrounded by a sealing arrangement comprising an inner seal and an outer seal with a plenum positioned between the inner seal and the outer seal, and wherein the plenum associated to the feedthrough is connected to the plenum associated to the passage, so that both the feedthrough plenum and the port plenum are evacuated by the support vacuum pump.

6. The vacuum system of claim 5, wherein the mechanical feedthrough comprises a movable shaft (601), a bearing (604) and a housing (602) which is being fixed, in particular bolted, to the wall (605) of the vacuum chamber, wherein the outer seal (606) comprises at least two elastomer O-rings, a first O-ring positioned between housing (602) and movable shaft (601), and a second O-ring positioned between housing (602) and wall (605) of the vacuum chamber, wherein the inner seal comprises two sealing areas, a first sealing area between the housing (602) and the wall (605) of the vacuum chamber, and a second sealing area between the housing (602) and the movable shaft (601) and wherein the plenum (608) comprises a first volume adjacent to the first sealing area and a second volume adjacent to the second sealing area, wherein the first and the second volume are interconnected by at least one hole drilled into the housing (602).

7. The vacuum system of claim 1, wherein the first vacuum chamber (13) and/or the second vacuum chamber (12) comprise an electrical feedthrough (8, 9), wherein the joining face of vacuum chamber (12) and feedthrough is (9) surrounded by a sealing arrangement comprising an inner seal (113) and an outer seal (112) with a plenum (110) positioned between the inner seal (113) and the outer seal (112), and wherein the plenum (110) associated to the feedthrough (9) is connected to the plenum (106) associated to the passage, so that both the feedthrough plenum (110) and the passage plenum (106) are evacuated by the support vacuum pump (21).

8. The vacuum system of claim 7, wherein the first vacuum chamber (13) and/or the second vacuum chamber (12) comprises a heating arrangement which is wired to the electrical feedthrough (8, 9), in particular a light bulb, and wherein the wiring is at least partially insulated by a heat-resistant material, in particular capton.

9. The vacuum system of claim 1, wherein an adapter piece (23) is fixed, in particular bolted, to the first vacuum chamber (13) and/or the second vacuum chamber (12), the adapter piece (23) comprising a standard vacuum flange, in particular a CF flange, wherein the joining face of vacuum chamber (12) and adapter piece (23) is surrounded by a sealing arrangement comprising an inner seal (121) and an outer seal (119) with a plenum (120) positioned between the inner seal (121) and the outer seal (119), and wherein the plenum (120) associated to the adapter piece (23) is connected to the plenum (106) associated to the passage, so that both the adapter plenum (120) and the passage plenum (106) are evacuated by the support vacuum pump (21).

10. The vacuum system of claim 1, wherein the first vacuum pump is a turbomolecular pump or an ion getter pump, wherein the second vacuum chamber (12) or a third vacuum chamber is evacuated by a second vacuum pump, in particular a turbomolecular pump or an ion getter pump, wherein the joining face of first vacuum chamber (13) and first vacuum pump and/or the joining face of second vacuum chamber (12) or third vacuum chamber and second vacuum pump is/are surrounded by a sealing arrangement comprising an inner seal (131, 121) and an outer seal (133, 119) with a plenum (132, 120) positioned between the inner seal (131, 121) and the outer seal (133, 119), and wherein the plenum (132, 190) associated to the first vacuum pump and/or the second vacuum pump is connected to the plenum (106) associated to the passage, so that both the pump plenum (132, 190) and the passage plenum (106) are evacuated by the support vacuum pump (21).

11. The vacuum system of claim 10, wherein the first vacuum pump and the second vacuum pump are formed by different stages of a multiport turbomolecular pump, wherein preferably the support vacuum pump is formed by a further stage of the multiport turbomolecular pump, in particular the last stage connected to a fore-vacuum pump.

12. The vacuum system of claim 10, wherein the first vacuum pump and the second vacuum pump are separate turbomolecular pumps, and wherein the support vacuum pump (21) is formed by a dedicated turbomolecular pump.

13. The vacuum system of claim 1, wherein the first vacuum chamber (13) and/or the second vacuum chamber (12) are made from metal, in particular aluminum, wherein at least one inner seal comprises a first sealing face consisting of the wall material (3) of the first vacuum chamber (13) and/or the wall material (2) of the second vacuum chamber (12), wherein the outer seal comprises an elastomer O-ring, preferably a fluoropolymer elastomer O-Ring, and wherein a second sealing face of the at least one inner seal consists of the wall material of an external component fixed, in particular bolted, to the first vacuum chamber (13) and/or the second vacuum chamber (12).

14. The vacuum system of claim 1, wherein at least one plenum (106, 132) and/or the connection (111, 14) between a first plenum (106, 132) and a second plenum (105) is/are made by holes drilled and/or channels milled in the wall material (3, 2) of the first vacuum chamber (13) and/or the second vacuum chamber (12).

15. The vacuum system of claim 1, further comprising multiple chambers interconnected by passages and/or apertures, wherein at least one further vacuum chamber is connected to the first vacuum chamber (13) and/or the second vacuum chamber (12), the further vacuum chamber being evacuated by a further vacuum pump, in particular a turbomolecular pump or ion getter pump, the further vacuum chamber and the first vacuum chamber (13) and/or second vacuum chamber (12) being connected by a passage, wherein the passage is surrounded by a sealing arrangement comprising an inner seal and an outer seal with a plenum positioned between the inner seal and the outer seal, the plenum being evacuated by the support vacuum pump (21), and wherein a first sealing face of the inner seal consists of the wall material (3, 2) of the first vacuum chamber (13) or the second vacuum chamber (12), in particular the inner seal being formed by direct contact between the wall material (3) of the first vacuum chamber (13) or the wall material (2) of the second vacuum chamber (12) and the wall material of the further vacuum chamber.

16. The vacuum system of claim 15, wherein the first vacuum chamber (13) comprises a cylindrical port of a first inner diameter machined in the wall material (3) with a stop rim having a smaller inner diameter than the first diameter being located at the axially inner end of the cylindrical port, wherein a cylindrical workpiece (1216) with a first outer diameter matching the first inner diameter is pressed against the stop rim, so that a first seal (134) is formed between the wall of the cylindrical workpiece and the stop rim, wherein the axially outside face of the cylindrical workpiece comprises a wall section of second outer diameter, the second outer diameter being smaller than the first inner diameter, wherein the cylindrical workpiece further comprises a membrane joining the wall parts of the first and the second outer diameter, the cylindrical port further comprising an axially outside section with a second inner diameter, the second inner diameter being bigger than the first inner diameter, wherein a second seal (127) is formed between the wall section of second outer diameter and the wall material of the further vacuum chamber, wherein the axially outside section is connected to one of the plenums evacuated by the support vacuum pump, and wherein a third seal (129) is formed between the wall material of the further vacuum chamber and the axially outside wall material of the first vacuum chamber, so that the third seal seals against atmosphere and the first seal and second seal provide sealing against the support vacuum.

17. A mass spectrometry system comprising a vacuum system (1) according to claim 1, wherein one vacuum chamber houses an ion source (701), in particular an electron impact ion source, wherein at least one vacuum chamber houses an ion-optical element (702), in particular an electrostatic analyzer, and wherein at least one further vacuum chamber is connected to or forms part of the vacuum system, wherein preferably one of the further vacuum chambers houses an ion detector (706).

* * * * *